United States Patent [19]

Danner

[11] 4,056,883

[45] Nov. 8, 1977

[54] HEATED ROLL INDUCTIVE HEATER CONSTRUCTION

[75] Inventor: Kenneth H. Danner, Nashville, Tenn.

[73] Assignee: Rosemount Inc., Eden Prairie, Minn.

[21] Appl. No.: 654,164

[22] Filed: Feb. 2, 1976

Related U.S. Application Data

[62] Division of Ser. No. 475,457, June 3, 1974, Pat. No. 3,961,151.

[51] Int. Cl.[2] ..... H05B 3/18

[52] U.S. Cl. ..... 29/611; 29/605

[58] Field of Search ..... 29/611, 605, 606, 618; 264/272; 336/96, 205; 219/10.79, 10.61

[56] References Cited

U.S. PATENT DOCUMENTS

| | | | |
|---|---|---|---|
| 3,223,553 | 12/1965 | Morey | 29/605 |
| 3,253,952 | 5/1966 | Merry | 29/605 |
| 3,308,414 | 3/1967 | Ostrander | 336/205 |
| 3,336,553 | 8/1967 | Cripps | 336/205 |
| 3,541,682 | 11/1970 | Hildebrandt | 264/272 X |

*Primary Examiner*—Francis S. Husar
*Assistant Examiner*—John S. Brown
*Attorney, Agent, or Firm*—Dugger, Johnson & Westman

[57] ABSTRACT

A heater construction for inductively heated rotating rolls which have inductive heater coils made up of a large number of turns of wire. The heater wire used for winding the coil has a high temperature insulation, preferably an inorganic material such as glass fiber, which may be impregnated with silicone in order to prevent abrasion as it is being wound. As each layer or wire is wound into coil form a coating of ceramic paste or ceramic material is applied to fill the interstitial spaces between the wires to provide a coil construction that has no voids within it that would permit relative movement between the wires to the extent that they could abrade and short out against each other.

3 Claims, 2 Drawing Figures

HEATED ROLL INDUCTIVE HEATER CONSTRUCTION

This is a division of application Ser. No. 475,457, filed June 3, 1974, and now U.S. Pat. No. 3,961,151.

BACKGROUND OF THE INVENTION

1. Field of the Invention

The present invention relates to a type of heater coil construction for use with an inductively heated rotating roll.

2. Prior Art

Induction heaters for rotating rolls are known, as shown in U.S. Pat. No. 3,772,492 issued to Morris H. Brogden et al. on Nov. 13, 1973. This patent, and patents cited therein, show various heater constructions.

Also, a type of heated roll is shown in U.S. Pat. No. 3,211,893 wherein a resistance heater is embedded in support material. A typical wire wound coil construction is shown in U.S. Pat. No. 3,508,024.

SUMMARY OF THE INVENTION

The present invention relates to a heater coil construction for use with rotating rolls.

In rotating rolls, there is always some vibration present, and alternate heating and cooling of the roll also tends to cause abrasion of the insulation from the wires due to expansion and contraction of the coil. Relative motion between adjacent loops of wire may result from the great temperature changes that occur in a heated roll of this type. In ordinarily constructed coils, where only the insulation normally on the wire is utilized, shorting between individual layers of the wire can occur, and less uniform temperature distribution may occur because of voids in the coil.

The specific construction comprises the helical wrapping of conventional insulated magnet wire on a coil form in layers. During the winding operation, a ceramic base cement or paste is applied in sufficient quantities to impregnate the insulation (normally a glass fiber wrap or braid), and to fill all of the voids between the adjacent wire turns of each layer and between the layers of wire.

DESCRIPTION OF THE PREFERRED EMBODIMENT

Figure 1:
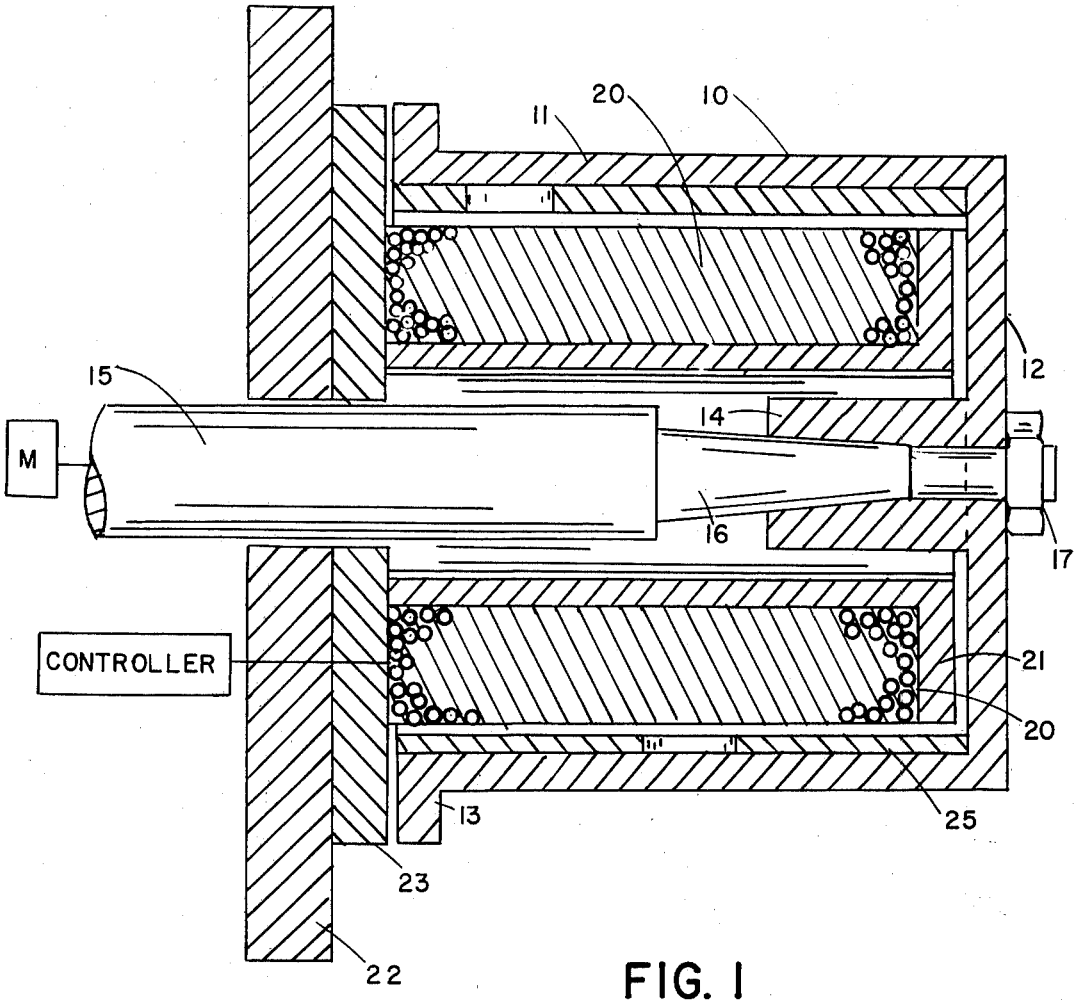
FIG. 1 is a vertical sectional view of a typical heated roll utilizing an inductive heater made according to the present invention.

Referring specifically to FIG. 1, a rotating processing roll illustrated generally at 10 comprises a cup shaped shell 11 that has an outer end wall 12. The shell 11 is open at its opposite end from the wall 12. The wall 12 has a hub 14 attached thereto and this hub 14 has a bore that fits over the end 16 of a shaft 15 that is powered from a motor shown schematically in the drawings. A suitable retaining device 17 holds the shell 11 in place on the shaft. The interior of the shell may have a highly conductive sheath 25 fixed in heat conducting relationship to the inner surface of the roll for purposes full disclosed in U.S. Pat. No. 3,772,492.

The roll assembly 10 can be used for processing synthetic fibers or the like. The roll heating means comprises an inductive heating coil 20 which is wound onto a high permeability coil carrier 21 that in turn is attached to a disc 23. The disc 23 is attached fixedly to a fixed frame 22. The coil 20, coil carrier 21, disc 23, and the frame 22 are stationary so that the roll assembly 10 rotates with respect to these parts.

Figure 2:
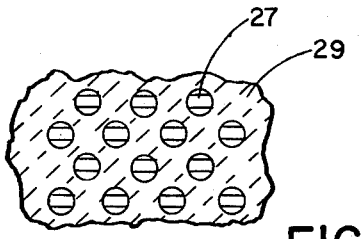
FIG. 2 is an enlarged cross sectional schematic view of an inductive heater coil constructed in accordance with the present invention.

The coil 20 is wound helically around the coil carrier 21, and typically the wire that is used, such as an aluminum wire, or a nickel plated or nickel clad copper wire, is helically wound into a layer and then a second layer is helically wound in place over the first layer. In general, the coil 20 comprises a multiplicity of layers, generally on the order of six to twelve layers of wire with a multiplicity of turns, the total number of turns being generally in the order of 300 to 800. As shown specifically in FIG. 2, the wire shown at 27 is covered with an insulation material such as a glass fiber braid or wrap that has some resilience to it, and each of the individual wire loops is spaced from the next adjacent wire loops. The glass fiber braid or wrap may be impregnated with a high temperature binder compound such as a silicone varnish. After the first layer has been wrapped onto the coil form, the wire loops are coated with a ceramic cement material, which can be painted on, sprayed on or troweled on and forced against the loops in a sufficient quantity to impregnate the glass braided or wrapped insulation on the wire, and to fill all of the voids between the wire loops. A covering of ceramic material is also left to form a base for the wrapping of the second layer of wire thereon.

The second layer of wire is wrapped into place, and the ceramic cement or material is again forced into the layer between the individual wire loops and also between the layers of wires so that each wire loop is surrounded by a ceramic material and separated from adjacent loops. Thus, when the entire coil is constructed in this manner each of the wire loops (and thus the entire length of the wire) will be embedded in a ceramic material and held in place on the coil carrier. The ends of the formed coil can be insulated from the coil carrier with suitable means such as Mica or other inorganic insulation that will withstand the high operating temperatures required, such insulation being sufficiently thick to take up thermal expansion between the wire coil and the steel mandrel. The surface of the coil carrier on which the wire is wrapped can be insulated with a suitable asbestos base insulation material.

The entire length of wire is suitably embedded in a ceramic material that will be cured into a rigid or semi-rigid support. The ceramic support prevents the wire loops from moving relative to each other so that they will not abrade and short out. Some movement of the coil has to be accommodated because of differential thermal expansion between the wires and the ceramic material which is partly taken up by the resilience or yielding of the inorganic insulation on the wires, together with the yieldability of the ceramic material and the resilience of the wire.

The end result is a stable, high temperature capability heating coil that can be used in environments that include starting and stopping of rolls, and vibration caused by operation of the rolls at high temperatures. In addition, the overall heat transfer of the coil is improved by minimizing temperature gradients and hot spots because of the substantially uniform support material which is provided for the loops of wire.

Ceramic pastes or cements are well known in the art and the material may be selected as desired for firm support of the wire. For example, aluminum oxide base paste such as that sold by Dylon Industries, Cleveland, Ohio, Grade C-3 or C-10 is satisfactory. The ceramic material forms a homogeneous coil carrier throughout, without voids.

The heater coil or wire has suitable leads attached to its opposite ends and a controller shown schematically in FIG. 1 is used for controlling the power to the heater coil. Suitable temperature sensors can be used in conjunction with the roll for feedback temperature signals to the controller so that the controller will supply power to the coil to keep the roll temperature at the desired level.

After the ceramic material has been added into the coil, the coil construction is completed, the coil assembly 20 may be heated to drive off any volatile carriers or solvent substances in the ceramic material.

I claim:

1. The method of constructing a coil for operation with heated rolls at high temperatures comprising the steps of providing a length of suitable heater wire having an inorganic insulation material surrounding said wire, helically wrapping said length of wire into loops arranged substantially in a layer about a central axis, filling the voids between each of the loops in the layer by forcing an insulating, hardening material against the loops until the voids are filled with said insulating, hardening material leaving a layer of said material over the loops in the layer, and adding additional layers of helically wound loops sequentially with each of the loops spaced from other loops and forcing said material into each layer to fill the voids between the loops of wire in each layer after each layer is wound and before another layer is wound, and to fill the voids between each of the layers with said insulating, hardening material.

2. The method as specified in claim 1 including the step of filling the voids with a ceramic cement material.

3. The method of claim 2 including the further step of heating said coil after completing the winding steps to drive volatile materials from said ceramic cement material.

* * * * *